US005437137A

United States Patent [19]

Allen

[11] Patent Number: 5,437,137

[45] Date of Patent: Aug. 1, 1995

[54] ROOF EDGE ANCHOR

[75] Inventor: James K. Allen, Coral Springs, Fla.

[73] Assignee: Land and Seas Business Corp., Inc., Ft. Lauderdale, Fla.

[21] Appl. No.: 130,384

[22] Filed: Oct. 1, 1993

[51] Int. Cl.[6] ..... E04B 1/38

[52] U.S. Cl. ..... 52/712; 52/698

[58] Field of Search ..... 52/58, 60, 730.1, 717.06, 52/823, 826, 712, 698

[56] References Cited

U.S. PATENT DOCUMENTS 3,907,445 9/1975 Wendt ..... 52/751 X 3,989,398 11/1976 Wendt ..... 52/751 X

*Primary Examiner*—Carl D. Friedman

*Assistant Examiner*—Creighton Smith

*Attorney, Agent, or Firm*—Hoffman, Wasson & Gitler

[57] ABSTRACT

A roof edge anchor, and in particular to a roof edge anchor which prevents the wind from lifting up, or peeling off, tile, shingles, and the like. The roof edge anchor includes a strapping mechanism with clamps spaced apart on and extending from a strapping plate so that the back plate can be positioned behind an existing roof edge and the clamps bent to conform to and surround the edge. The clamps and the strapping plate have holes in them to accommodate fasteners for securing the roof edges to the underlying building structure. The anchor is in sections of preferably four foot lengths.

13 Claims, 2 Drawing Sheets

ROOF EDGE ANCHOR

BACKGROUND OF THE INVENTION

The present invention relates to a roof edge anchor, and in particular to a roof edge anchor which prevents the wind from lifting up, or peeling off, tile, shingles, and the like.

Roofs are very susceptible to damage from strong winds and hurricanes. Most of the damage roofs sustain start at the edges of the roofs and spreads inward. The damage to the edges provides the wind and storm access to the roof felts, which are, without any edge supports, extremely vulnerable to being pulled or torn off by the wind. Most roofs have a multiple part edge. The edge includes a sub fascia, a fascia, a fir strip and an eave drip. The sub fascia is secured to the side of the roof, and the fascia is secured to the sub fascia. The fir strip is provided so that the eave drip will extend beyond the sub fascia and fascia. Such a construction is very vulnerable to winds pulling and lifting the eave drip and underlying structure completely off of the house. Furthermore, such existing roof structures are susceptible to torque of the roof edge during high wind or storms.

In view of the foregoing, it is an object of the present invention to provide a roof edge anchor which makes the roof less susceptible to wind damage.

Another object of the present invention is to provide a roof edge anchor which secures to a roof edge to resist wind uplift.

Another object of the invention is to provide a roof edge anchor which prevents torque of the roof edge.

Still another object of the present invention is to provide a roof edge anchor which prevents peeling of the roof system at the outer exposed perimeter.

Another object of the present invention is to provide a roof edge anchor which is easy to install.

Another object of the present invention is to provide a roof edge anchor which can be applied to existing roof structures and gives a correct cosmetic appearance.

These and other objects of the present invention will become apparent to those skilled in the art from the description which follows.

SUMMARY OF THE INVENTION

The roof edge anchor of the present invention includes a strapping mechanism with clamps spaced apart on and extending from a strapping plate so that the back plate can be positioned behind an existing roof edge and the clamps bent to conform to and surround the edge. The clamps and the strapping plate have holes in them to accommodate wood screws for securing the roof edges to the underlying building structure. The anchor is in sections of preferably four foot lengths. The mounting screws may have washers and pass through the fir strip, fascia and sub fascia to secure to the structure of the house.

DETAILED DESCRIPTION OF THE PREFERRED EMBODIMENT

Figure 1:
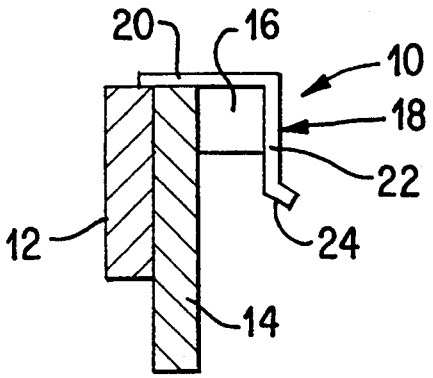
FIG. 1 is a side view of a conventional roof edge.

Referring to FIG. 1, a conventional roof edge is illustrated. The roof edge 10 has a sub fascia 12 which is adjacent the house structure (not shown). Fascia 14 is attached to the sub fascia, and in the example shown in FIG. 1 is not as thick as the sub fascia 12, but is wider. A fir strip 16 is attached to upper edge of the fascia 14. The thickness and width of the illustrated fir strip 16 are approximately equal. An eave drip 18 is attached to the fir strip 16. Eave drip 18 has a horizontal portion 20 and a substantially vertical portion 22. The fir strip 16 acts as a spacer so that the vertical portion 22 of the eave drip 18 is spaced away from the fascia 14. The horizontal portion 20 of the eave drip 18 is positioned on top of and adjacent to the upper sides of the sub fascia 12, fascia 14, and fir strip 16. The vertical portion 22 of the eave drip 18 has its lower edge 24 angled away from the house structure.

The sub fascia 12, fascia 14, fir strip 16 and eave drip 18 are secured to one another and to the house structure by nails. One consequence of such a structure is that it is very susceptible to wind uplift where the wind lifts the edge of the roof off the house structure exposing the roof system to further damage. Most roof damage occurs only when the edge has been torn away. Therefore, it is very desirable to maintain the roof edge intact during high winds.

Figure 2:
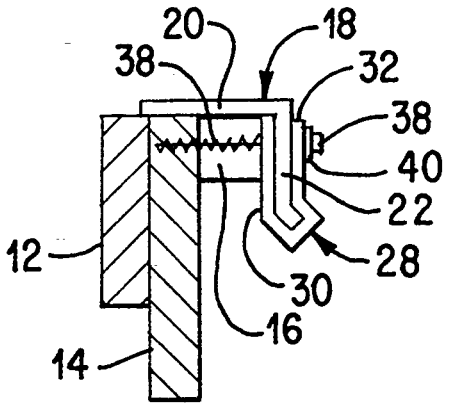
FIG. 2 is a side view of an anchor according to the present invention.
Figure 3:
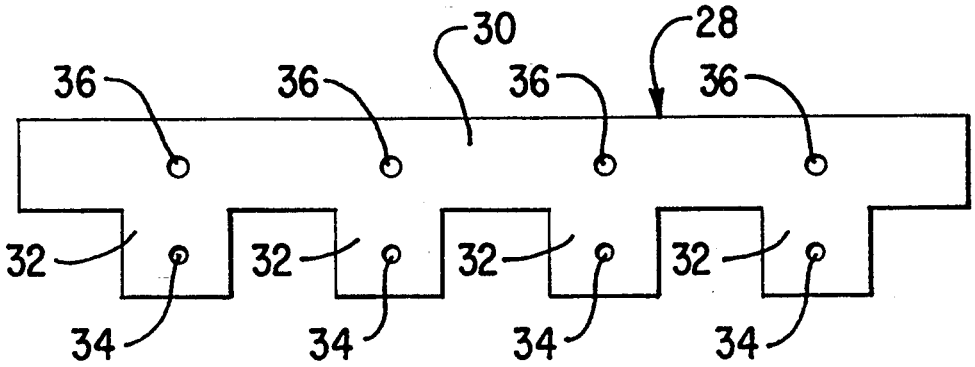
FIG. 3 is a planar view of an anchor according to the present invention.
Figure 5:
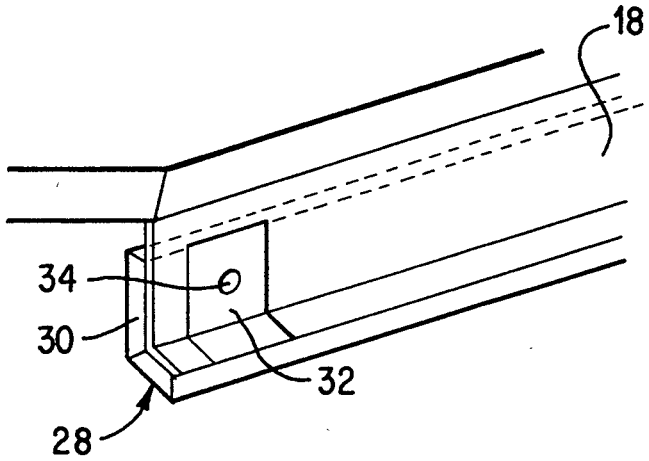
FIG. 5 is perspective view of a portion of the roof edge of FIG. 3 with the roof edge anchor of the present invention shown partially in phantom.

Referring to FIGS. 2 and 3, the roof edge anchor 28 of the present invention is illustrated, and includes a strapping plate 30 and a series of clamps 32. In the preferred embodiment, the strapping plate 30 is four feet long and the clamps 32 extend two inches from the strapping plate 30 at twelve inch intervals. Each clamp 32 has a hole 34 formed in the center. The strapping plate 30 has a hole 36 corresponding to each hole 34 so that, when clamps 32 are bent to surround the eave drip 18 as shown in FIG. 2, the holes 34 and 36 align with one another. The strapping plate 30 is made of sheet metal, preferably galvanized steel. Once the anchor 28 has been positioned, with the strapping plate 30 positioned behind the back of the eave drip 18, the clamps 32 are preformed to conform to the shape of the eave drip 18, as shown in FIG. 5. Wood screws 38 are inserted into the holes 34 so that they extend through the eave drip 18, the holes 36 in the strapping plate 30, the fir strip 16, the fascia 14, and the sub fascia 12.

The wood screws 38 have washers 40, preferably made from neoprene or weather resistant aluminum, to effectively pull the clamps 32 tight against the eave drip 18. In the preferred embodiment the roof edge anchor is four feet long. Such four foot sections are easy to handle and install, either by a homeowner or contractor. The roof edge anchor can be installed during original construction or can be retrofitted to an existing house. In the latter instance, the eave drip 18 need not be removed, and the anchor sits over the existing eave drip 18.

Figure 4:
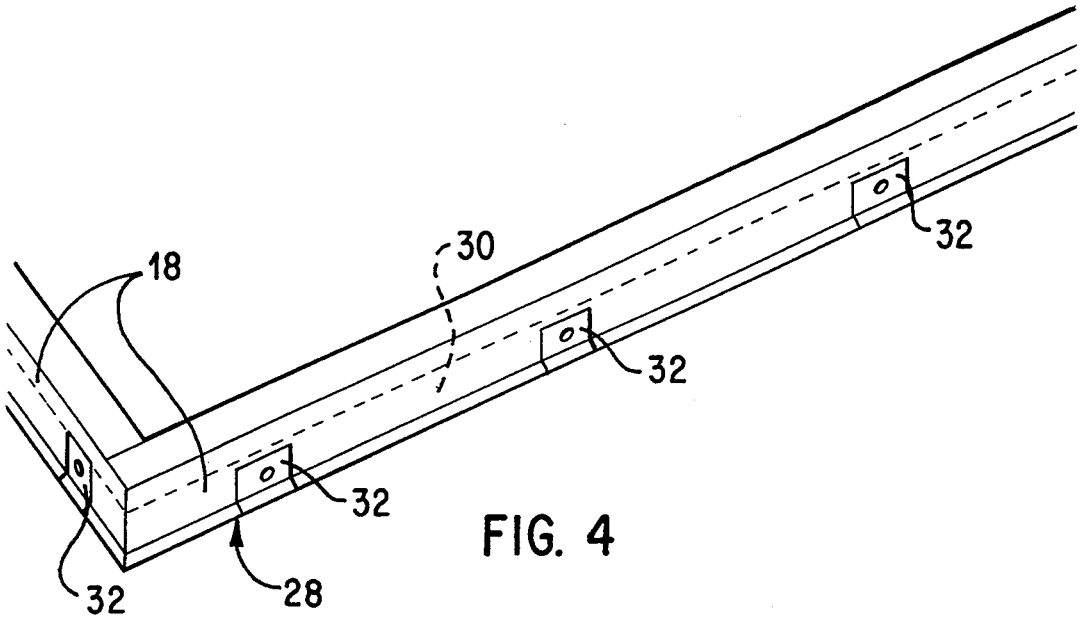
FIG. 4 is a perspective view of a roof edge with the roof edge anchor of the present invention installed.

FIG. 4 shows a roof edge with a series of roof edge anchors 28 installed. From FIG. 4 it is apparent that only the clamps 32 are visible when seen head on. The clamps 32 can be painted the same color as the eave drip 18 to make them even less visible. In this manner the roof edge anchor 28 provides roof protection while simultaneously giving a correct cosmetic appearance.

The roof edge anchor 28 provides greater strength to the roof edge by more securely connecting the eave drip 18, the fir strip 16, the fascia 14 and the sub fascia 12. As a result the structure is better able to resist torque forces. By securely fastening the edges of the roof, damage from the wind lifting up or peeling off tiles, shingles, and the like is prevented.

While the preferred embodiment was described in detail, modifications and variations of the present invention that are obvious to one skilled in the art, such as making the anchor from rigid material besides steel such as fiber glass changing the dimensions, or utilizing other fasteners, similar to the wood screws 38, or utilizing U-shaped multiple clamping means without a strapping plate, are intended to be covered by the following claims.

What is claimed is:

1. A roof edge anchor for anchoring a roof edge to a building structure comprising:

a strapping plate;

multiple clamping means extending from said strapping plate; and fastening means for fastening said clamping means and said strapping plate to an eave drip extending from said building structure;

wherein said fastening means is adapted to extend through said multiple clamping means, said eave drip, and said strapping plate.

2. A roof edge anchor as recited in claim 1, wherein said strapping plate is metal, and said multiple clamping means are integrally formed with said strapping plate, said multiple clamping means extending from an edge of said strapping plate at set intervals.

3. A roof edge anchor as recited in claim 2, wherein a first aperture is formed in the center of each of said multiple clamping means, and said strapping plate has a series of second apertures, corresponding to said first apertures, said fastening means extending through said first and second apertures.

4. A roof edge anchor as recited in claim 1, wherein said fastening means are wood screws.

5. A roof edge anchor as recited in claim 3, wherein said fastening means are wood screws.

6. A roof edge anchor as recited in claim 3, wherein said clamping means bend to conform to said eave drip so that said eave drip is sandwiched between said multiple clamping means and said strapping plate.

7. A roof edge anchor as recited in claim 4, wherein said wood screws extend into a fir strip, a fascia and sub fascia of said roof edge and building structure.

8. A roof edge anchor as recited in claim 5, wherein said wood screws extend into a fir strip, a fascia and sub fascia of said roof edge and building structure.

9. A roof edge anchor as recited in claim 2, wherein said strapping plate is approximately four feet long, said multiple clamping means extend approximately two inches from said strapping plate, and said multiple clamping means are spaced apart along said edge of said strapping plate at approximately twelve inch intervals.

10. A roof edge anchor as recited in claim 4, further comprising weather resistant washers, said wood screws extending through said washers to pull said multiple clamping means against said eave drip.

11. A roof edge anchor as recited in claim 5, further comprising weather resistant washers, said wood screws extending through said washers to pull said multiple clamping means against said eave drip.

12. A method of anchoring a roof edge to a building structure comprising the steps of:

positioning a strapping plate behind an eave drip of said roof edge;

bending multiple clamping means extending from said strapping plate around said eave drip to sandwich said eave drip between said multiple clamping means and said strapping plate;

inserting fastening means through first apertures formed in the center of each of said multiple clamping means, through said eave drip and through second apertures, formed in said strapping plate, and corresponding to said first apertures, so that said fastening means connects to said building structure.

13. A method as recited in claim 12, further comprising the step of inserting said fastening means through washers so that when said fastening means are connected to said building structure, said multiple clamping means are drawn against said eave drip.

* * * * *